US009109610B2

(12) United States Patent
Streng et al.

(10) Patent No.: US 9,109,610 B2
(45) Date of Patent: Aug. 18, 2015

(54) RADIAL BLOWER

(75) Inventors: Gunter Streng, Schrozberg (DE); Rainer Müller, Zweiflingen-Pfahlbach (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 99 days.

(21) Appl. No.: 12/731,437

(22) Filed: Mar. 25, 2010

(65) Prior Publication Data

US 2010/0254826 A1 Oct. 7, 2010

(30) Foreign Application Priority Data

Mar. 25, 2009 (EP) ..... 09004232

(51) Int. Cl.

| | |
|---|---|
| ***F04B 17/00*** | (2006.01) |
| ***F04D 29/58*** | (2006.01) |
| ***F04D 25/06*** | (2006.01) |
| ***F04D 29/42*** | (2006.01) |

(52) U.S. Cl.

CPC ..... *F04D 29/5813* (2013.01); *F04D 25/06* (2013.01); *F04D 25/068* (2013.01); *F04D 29/424* (2013.01)

(58) Field of Classification Search

CPC . F04D 25/082; F04D 29/582; F04D 29/5806; F04D 29/5813; F04D 17/105; F04D 17/162; F04D 1/006; F04D 25/06; F04D 29/424; F04D 25/068

USPC ..... 417/353, 423.1, 423.7, 354; 415/98, 415/154.1, 187, 203, 206, 214.1; 310/67 R, 310/71, 43, 90; 165/80.3

See application file for complete search history.

(56) References Cited

U.S. PATENT DOCUMENTS

| | | | | |
|---|---|---|---|---|
| 2,661,894 | A * | 12/1953 | Stevenson | 417/353 |
| 2,776,088 | A | 1/1957 | Wentling | |
| 2,798,659 | A * | 7/1957 | Tweedy | 417/353 |
| 2,830,752 | A * | 4/1958 | Wentling | 417/354 |

(Continued)

FOREIGN PATENT DOCUMENTS

| | | | |
|---|---|---|---|
| DE | 3916791 | C3 | 5/1989 |
| DE | 198 41 762 | A1 | 3/2000 |

(Continued)

OTHER PUBLICATIONS

EP0985829_SpecificationMachineTranslation.*

(Continued)

*Primary Examiner* — Peter J Bertheaud
*Assistant Examiner* — Dnyanesh Kasture
(74) *Attorney, Agent, or Firm* — Brinks Gilson & Lione

(57) ABSTRACT

The invention relates to a radial blower, with at least one axial air inlet port (1) and with a radial air outlet port (2). The radial blower has a housing subassembly and a fan subassembly with an electric motor (3) and a fan wheel (4). The housing subassembly has at least one holding part (5) arranged in the region of the axial air inlet port (1) for supporting reception of a carrying part (6), and two shell parts (71, 72) releasably connectable to one another. The holding part (5) is fastened between the shell parts. The electric motor (3) of the fan subassembly is an electronically commutated direct current motor. Control electronics (19) are arranged in a terminal box (13) for the reception of motor connections (12). The terminal box is fastened, to the underside of a lower shell part (72) of the housing subassembly.

14 Claims, 5 Drawing Sheets

(56) References Cited

U.S. PATENT DOCUMENTS

| | | | | |
|---|---|---|---|---|
| 2,895,666 | A * | 7/1959 | Girdwood | 417/354 |
| 2,976,808 | A * | 3/1961 | Whitehurst | 417/353 |
| 4,128,778 | A * | 12/1978 | Merkle et al. | 310/67 R |
| 4,458,962 | A * | 7/1984 | Pohl-Michel | 312/211 |
| 4,694,210 | A | 9/1987 | Elliott et al. | |
| 5,085,465 | A * | 2/1992 | Hieahim | 280/738 |
| 5,281,092 | A * | 1/1994 | Sullivan | 415/206 |
| 5,738,503 | A * | 4/1998 | Schmidt-Marloh et al. | 417/423.7 |
| 5,806,169 | A * | 9/1998 | Trago et al. | 29/596 |
| 5,997,246 | A * | 12/1999 | Humbad | 415/119 |
| 6,821,095 | B2 * | 11/2004 | Dooley et al. | 417/234 |
| 6,833,990 | B2 * | 12/2004 | LaCroix et al. | 361/688 |
| 2004/0241005 | A1 * | 12/2004 | Hersel et al. | 417/48 |
| 2005/0116675 | A1 | 6/2005 | Dooley | |
| 2007/0020085 | A1 | 1/2007 | Takemoto | |
| 2007/0212219 | A1 | 9/2007 | Teshima et al. | |
| 2008/0197794 | A1 * | 8/2008 | Vermeir et al. | 318/400.06 |
| 2008/0260527 | A1 | 10/2008 | Aoki et al. | |
| 2009/0010782 | A1 * | 1/2009 | Bartsch et al. | 417/423.2 |
| 2012/0034077 | A1 * | 2/2012 | Jairazbhoy et al. | 415/203 |
| 2013/0189134 | A1 * | 7/2013 | Irie et al. | 417/423.7 |

FOREIGN PATENT DOCUMENTS

| | | | | |
|---|---|---|---|---|
| DE | 0985829 | * | 11/2000 | F04D 29/62 |
| EP | 0501168 | B1 | 2/1992 | |
| EP | 0652375 | A1 | 5/1995 | |
| EP | 1375925 | B1 | 9/2003 | |
| EP | 1 484 509 | A1 | 3/2004 | |
| FR | 2742813 | A1 | 12/1995 | |
| JP | 11230097 | A * | 8/1999 | F04D 17/10 |
| JP | 200145700 | A | 5/2000 | |
| JP | 2000145700 | A * | 5/2000 | F04D 29/66 |

OTHER PUBLICATIONS

Full Machine Translation of Streng et al (EP Patent No. 0985829, or DE 19841762 C2).*

Machine Translation of JP 2000-145700 to Shinkai, Hidetaka—published May 2000.*

Machine Translation of JP 11230097 to Morishita, K—published Aug. 1999.*

International Search Report—Nov. 9, 2009.

* cited by examiner

RADIAL BLOWER

CROSS REFERENCE TO RELATED APPLICATION

This application claims priority to European Patent Application No. 09 004 232.6, filed Mar. 25, 2009.

FIELD OF THE INVENTION

The invention relates to a radial blower, with at least one axial air inlet port and with a radial air outlet port, consisting of a housing subassembly and of a fan subassembly which comprises an electric motor and a fan wheel. The housing subassembly having at least one holding part, which is arranged in the region of the axial air inlet port and serves for the supporting reception of a carrying part of the fan subassembly, and two shell parts which are connectable releasibly to one another and divide the air inlet port and between which the holding part is fastened in the assembled state.

BACKGROUND OF THE INVENTION

A blower of the type of the present invention is known from German patent specification DE 198 41 762 C2 and has proved useful in practice.

Double-flow radial blowers, as they are known, are employed to an increased extent in many domestic applications, for example in air conditioning applications and in other sectors. Double-flow means that the radial blower possesses two inlet ports which are located on axially opposite sides of the blower. Such a double-flow is also described as a preferred version for the blower described in DE 198 41 762 C2. In this case, an electric motor is used, which is mounted in a vibration-insulating manner on both sides in an elastic element. The connecting cable, coming from the engine, is routed through a partially hollow shaft, via a carrying arm, to a terminal box belonging to the housing subassembly. The electric motor is an alternating current motor which is designed as a closed external rotor motor. In the terminal box, the ends of the connecting lines of the motor are connected, and both connecting lines have an operating capacitor and fuses and also a connection terminal strip for the pluggable connection of a motor connecting cable are accommodated in the terminal box.

The object on which the present invention is based to provide a blower of the generic type described above, which, as compared with the known blower, has a marked reduction in weight and can convey at least the same air quantity while having a lower energy consumption. At the same time, the noise values of the blower in accordance with this invention should also not increase. This object is connected with the requirements of legislators and consumers for improved mass/power ratios of blowers of this type.

The object is achieved, according to the invention, in that the electric motor of the fan subassembly is an electronically commutated direct current motor (referred to, further, as an EC motor).

The electric motor according to the invention is therefore a brushless direct current machine in which the rotor has permanent magnets and the stator has a plurality of magnet coils. The stator may, in particular, be of three-phase design. The coil windings of the stator are connected, for electronic commutation, via a bridge circuit, in which transistors, such as preferably metal oxide semiconductor field-effect transistors (MOSFET) or bipolar transistors with an insulated gate electrode (IGBT), may be used. Particularly in the case of lower powers, the circuit may be designed as an integrated circuit (power IC), and therefore we may also speak of conversion electronics. These electronics constitute essentially a three-phase regulator, such as is also used in a similar way in frequency converters, so that the electric motor can be fed with direct voltage. Since such electronics can also additionally fulfill other functions, especially "control electronics" will be used further herein in this respect.

By means of the blower according to the invention, advantageously, because of the high motor efficiency and its compact type construction, higher powers can be achieved in the case of identical construction volumes and markedly reduced masses, as compared with a known blower, or identical powers can be achieved in the case of lower construction volumes and masses.

The motor may in this case have a rigid shaft, in the same way as the alternating current motor of the known blower, the stator of the motor being fixed on the shaft. According to the invention, therefore, it is likewise an external rotor motor, of which the shaft ends on both sides can be fastened in carrier elements of the blower.

In this case, as mentioned in the introduction, a drive decoupling serving for reducing solid-borne sound and bearing noises may take place in an appropriate way via elastic elements, such as elastomeric parts which are attached to the shaft via a fixing part. Thus, by virtue of the comparatively very low-mass EC motor, a very good decoupling result can be achieved.

As also illustrated in detail by the drawings of the invention, the blower according to the invention may advantageously be constructed in a modular manner, in which case the individual basic elements can be assembled simply by being plugged together and snapped or screwed to one another. The assembly times can thereby be kept extremely short.

According to the invention, as regards the electronic commutation, there may be provision for the motor to be sensor-controlled, in which case the position of the rotor is detected by at least one magnetic, electrical or optical position sensor, for example a hall sensor, a magnetoresistor or a potentiometer.

It is particularly preferable, however, to use such an EC motor which is controlled without a sensor, the position of the rotor being detected by means a counter voltage induced in the stator, and this countervoltage being used, via correspondingly treated signals, for fixing the commutation time points.

The counter voltage is linearly dependent on the motor rotational speed and on the exciting intensity and can therefore also be used to set the rotation speed exactly. Further, therefore, there is advantageously the possibility of utilizing this and other control and regulating functions of the EC motor in the blower according to the invention. The additional advantage, as compared with a sensor-controlled EC motor, is, in position detection via the countervoltage, also that there is no need to use position sensors which are sometimes susceptible to faults.

In EC motors, the control electronics are usually integrated into the motor and, depending on the power of motor, can be of corresponding size. In this case, these electronics, which are not required in alternating current motors, are located typically in the intake region of the blower, because sufficient cooling can also take place there due to the sucked-in air, so that a prescribed operating temperature is not overshot. To be precise, cooling is absolutely necessary for the functioning capacity of the electronics. As a result, however, a certain obstruction is caused in the intake region of the blower and, precisely in the case of blowers having double-sided suction, may give rise adversely to an uneven distribution of the sucked-in air.

In an advantageous embodiment of the invention, therefore, there may be provision for control electronics to be accommodated, separately from the EC motor, in a terminal box, as is also known from the prior art in the case of alternating current motors, although, there, with the exception of the motor connections, the operating capacitor, etc. Since the electronics are arranged at a spatial distance from the motor in the terminal box, unfavorable mutual influences are prevented, and the motor and electronics components supplement one another optimally.

In particular, an electronic module to be cooled specially, that is to say, essentially, a circuit board, on which the control electronics are arranged or connected, may be insertable into a clearance of the terminal box or onto a plug location on the underside of the blower. A cooling body of the electronic module may in this case project into a corresponding clearance on the lower housing shell and thus be in direct contact with the airstream inside the blower. By action being exerted by the blower air, an optimal flow around the cooling body takes place, but without the blower internal volume at the same time being reduced or the air stream disturbed.

Since there is then no need to ensure temperature limitation in the motor due to electronic components, a higher intrinsic heating of the motor may be permitted on account of the separation of the motor and electronics, to be precise, for example, an intrinsic heating, such as arises pursuant to the admissible thermal load upon materials used for insulating the motor.

The stator of the EC motor may in this case be encapsulated, completely, by means of a pour-around (or potting) material, preferably a thermosetting plastic, with the result that an optimal discharge of heat from the motor can be achieved and all the current-carrying parts are insulated and protected from contact.

In such an encapsulation of the stator, the rotating rotor may, in contrast to the known direct current motors, be designed not as a closed bell, but so as to be open on both sides on the end faces. Despite of such an open rotor, however, a high IP protection class can be achieved because the stator is encased on all sides. As is known, this IP protection class is understood to mean, according the standard EN 60529, the degree of protection with respect to contact, foreign bodies, such as dust, and moisture. The orifices in this case have the effect that the air conveyed by the blower flows around the stator, and at the same time it is also routed through the gap usually present between the rotor and stator, thus counteracting in advance an excessive heating of the motor components.

Further, owing to the described spatially separated combination of the EC motor and electronic module, an adaptation of the blower according to the invention to the most diverse possible customer interfaces is also possible quickly and simply. A preferred field of use in this case are fume extractor hoods, where the blower according to the invention can be used. In this field in particular, blowers with closed alternating current motors have hitherto being employed on account of the moist and often greasy exhaust air. In this respect, the invention constitutes an efficient and energy-saving alternative having the possibility of simple substitution. Any power range, whether with or without additionally required electronics, with part electronics or with full electronics, can be covered by the blower according to the invention. In this case, possible different gradings of the electronic modules can be adapted to the different air powers of the blower.

BRIEF DESCRIPTION OF THE DRAWINGS

Further advantageous functions of the invention are contained in the subclaims and the following description. The invention is explained in more detail by means of an exemplary embodiment illustrated in the accompanying drawing figures in which:

DETAILED DESCRIPTION OF THE INVENTION

Figure 1:
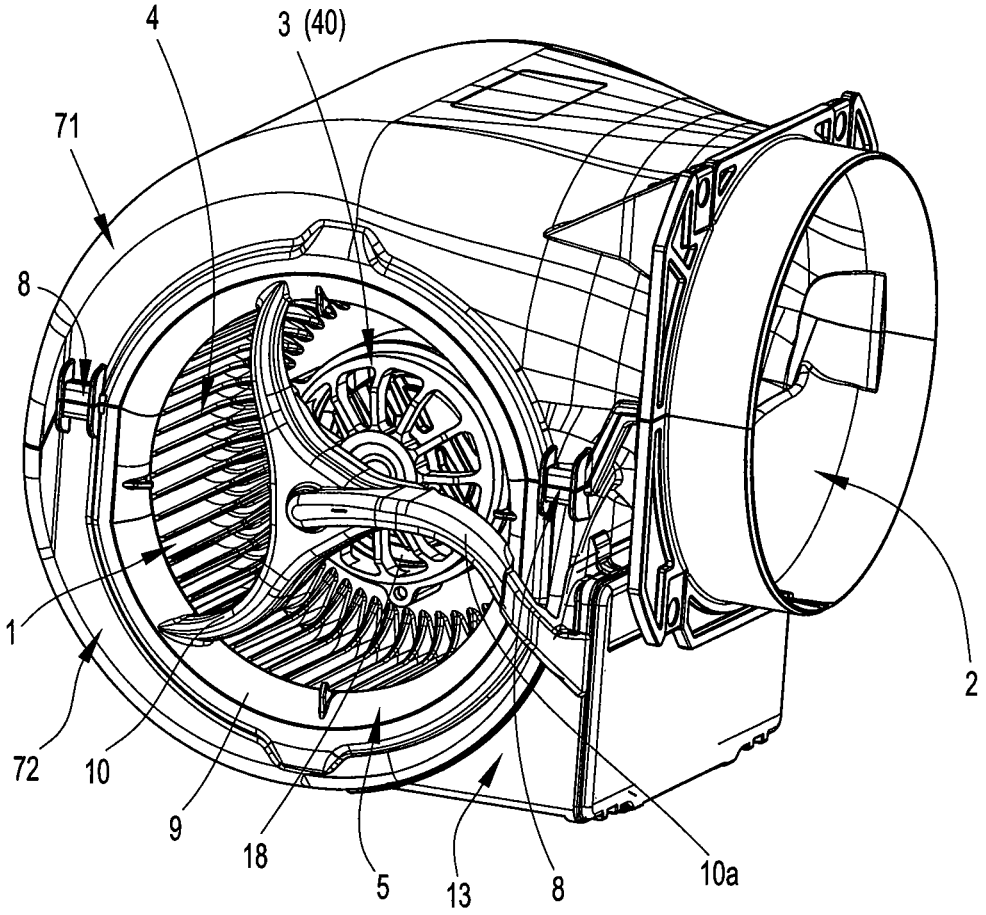
FIG. 1 shows a perspective side view of a version of a radial blower according to the invention.

In the various figures of the drawing, the same parts are also always given the same reference symbols, and therefore they are usually also in each case described once only.

Figure 2:
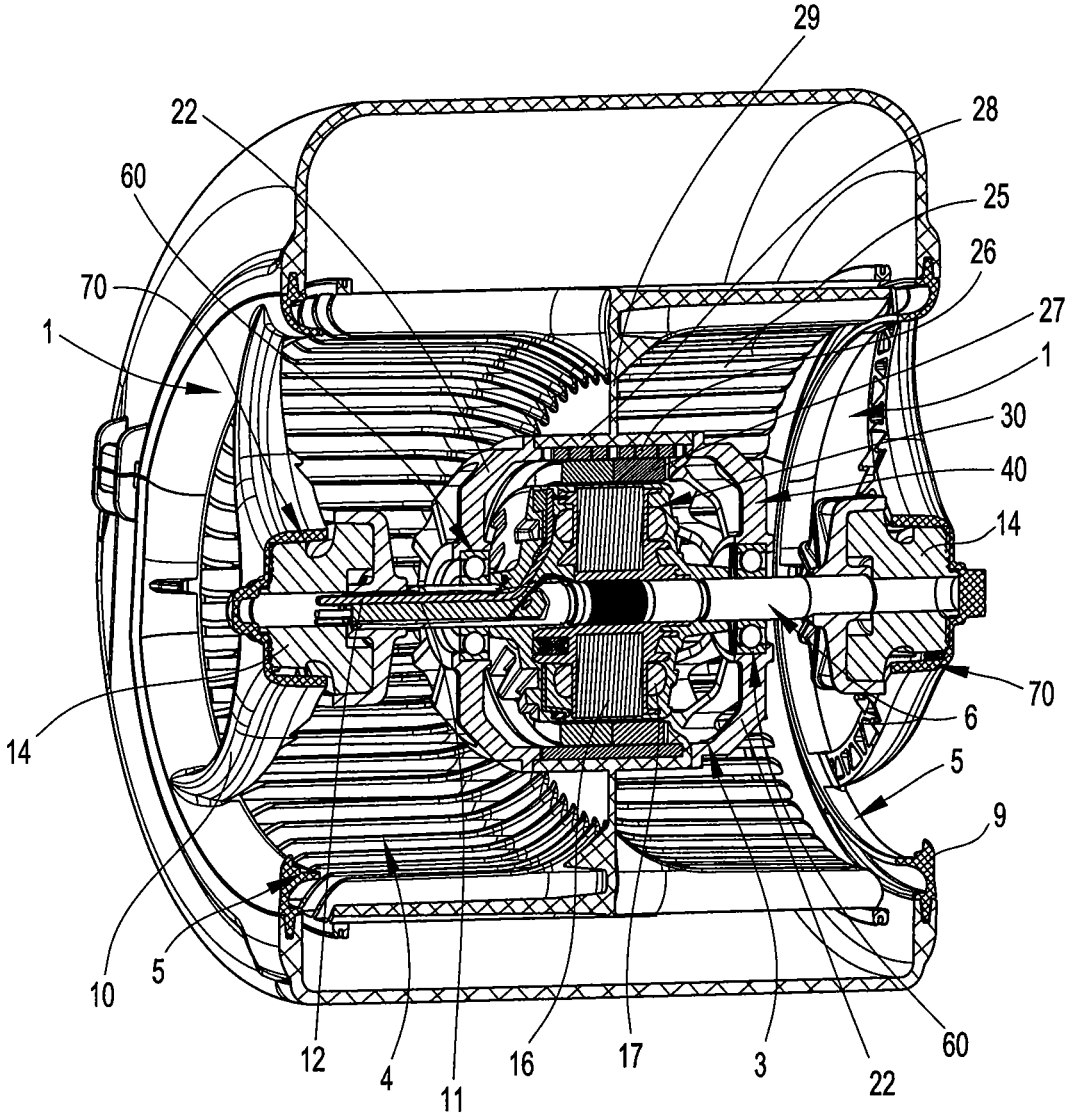
FIG. 2 shows a perspective longitudinal section through the radial blower according to the invention illustrated in FIG. 1.

As may first be gathered from FIG. 1, a blower according to the invention has at least one axial air inlet port 1, in the present preferred case of double-flow design, as shown in FIG. 2, two air inlet ports 1 lying axially opposite one another, and a radial air outlet port 2.

The blower according to the invention in this case consists of a housing subassembly and of a fan subassembly, the latter comprising an electric motor 3 and a fan wheel 4. The invention is suitable particularly for a version in which, as in the illustration shown, the electric motor 3 is designed as an external rotor motor.

The housing subassembly comprises at least one holding part 5, in the case illustrated two holding parts 5 which are arranged in each case in the region of the axial air inlet port 1 and serve for the supporting reception of a carrying part (or shaft) 6 of the fan subassembly.

Figure 3:
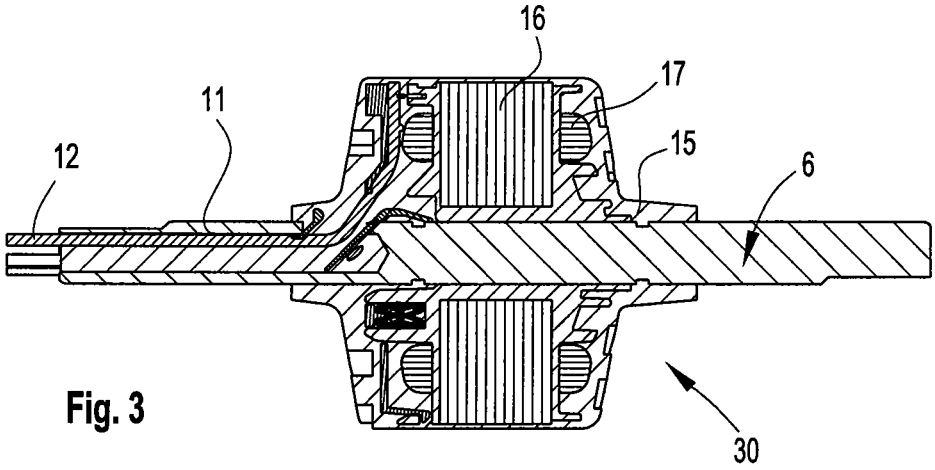
FIG. 3 shows a longitudinal section through a stator of the radial blower according to the invention.

As shown in FIGS. 2 to 5, the carrying part 6 is designed as an elongate carrying shaft which is held with its ends in the holding parts 5 and on which, on the one hand, the stator 30 of the electric motor 3 is seated fixedly in terms of rotation, as illustrated in detail in FIG. 3, and on which, on the other hand, the rotor 40 is mounted rotatably as an external rotor.

The housing subassembly comprises, further, two shell parts 71 and 72 connectable releasably to one another and dividing the air inlet port 1, an upper half shell part 71 and a lower half shell part 72, between which the holding part 5 is held in the assembly state. The separating point between the shell parts 71 and 72 in this case lies in a plane which runs approximately centrally with respect to the outlet port 2 and with respect to the axial position of the motor 3. The shell parts 71 and 72 preferably consist of plastic, so that the individual components of the housing subassembly can advantageously be produced by the injection molding method.

In the version shown, the shell parts 71 and 72 are connectable to one another via clamps 8. In order to hold the upper and the lower shell parts 71 and 72 together, overall four clamps 8 are attached, two of which are arranged, in the illustration according to FIG. 1, in the rear region of the housing and two in the front region of the housing laterally with respect to the air inlet port 1 and to the air outlet port 2.

The holding parts 5 have, in particular, braced frames 9 having an annular basic configuration. The bracing is in this case formed by three carrying arms 10 connected to one another in a star-shaped manner. The carrying arms 10 in each case run from the middle of the holding part 5 arcuately outward and are connected there to the frame 9. The space between the braces and the frames 9 of the holding part 5 in each case forms the axial air inlet port 1.

As shown in FIG. 2, the carrying part 6 is a stationary, that is to say non-rotating, carrying shaft extending from the electric motor 3 on both sides. At least one end, held in the holding part 5, of the carrying shaft, this also being shown more clearly in FIG. 3, has in this case an inner guide duct 11 for the reception of connecting lines 12 for the electric motor 3. The shaft is thus designed partially, emanating from one shaft end, as a hollow shaft. The connecting lines 12 are lead through the guide duct 11 into the inner space of the electric motor 3 to the stator 30. The hollow shape also ensures that a high geometrical moment of inertia on the carrying part 6 is established, this being important from the point of view of a flexural and, where appropriate, also torsional load. The geometrical moment of inertia is, together with the modulus of elasticity, a measure of the rigidity of a planar cross section in terms of the load situations mentioned. There is therefore no need to use a steel shaft, without the strength or stability of the stator 30 being impaired and without an enlargement of the geometric dimensions being necessary for this purpose.

Those ends of the connecting lines 12 which are not in each case connected to the stator 30 can be routed through a carrying arm 10*a*, advantageously designed as a cable duct, and end in a terminal box 13 in which, for example, fuses and similar structural elements and also a junction terminal strip for the pluggable connection of an external motor junction cable, not illustrated, are located.

Figure 7:
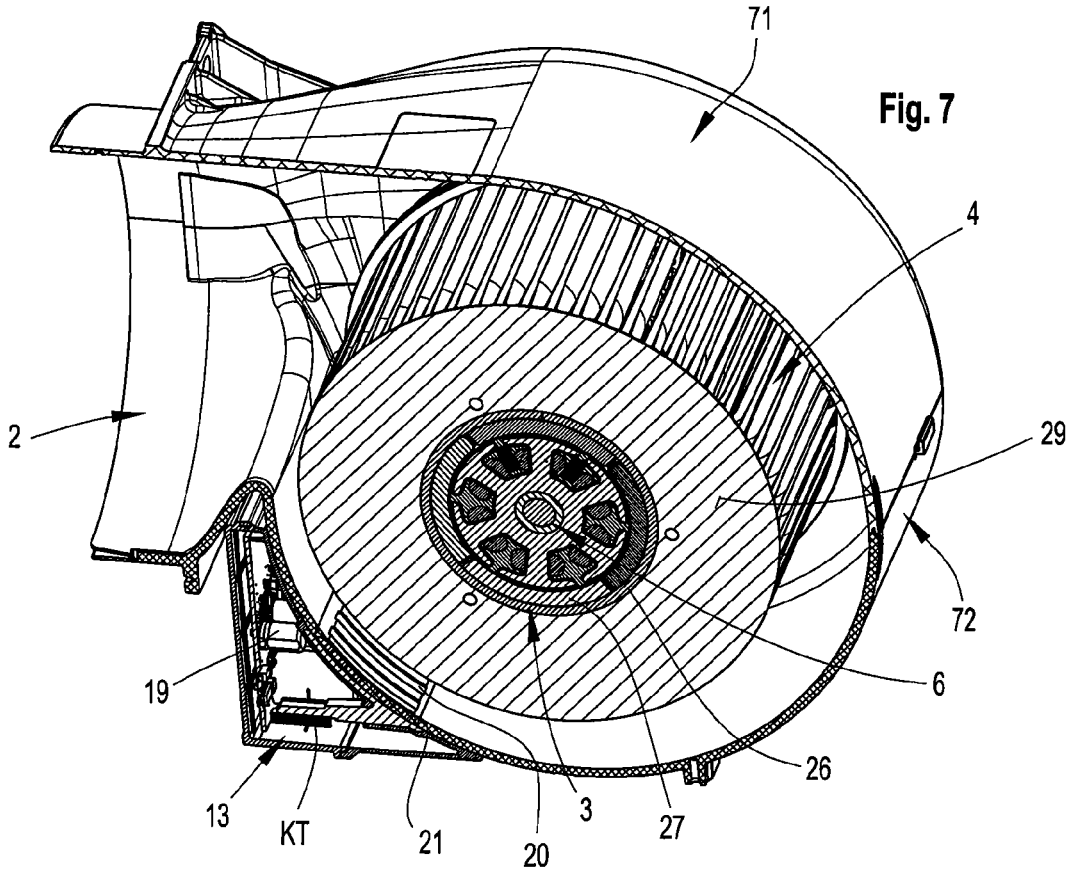
FIG. 7 shows a perspective illustrated section through the radial blower according to the invention transversely to its longitudinal axis.
Figure 8:
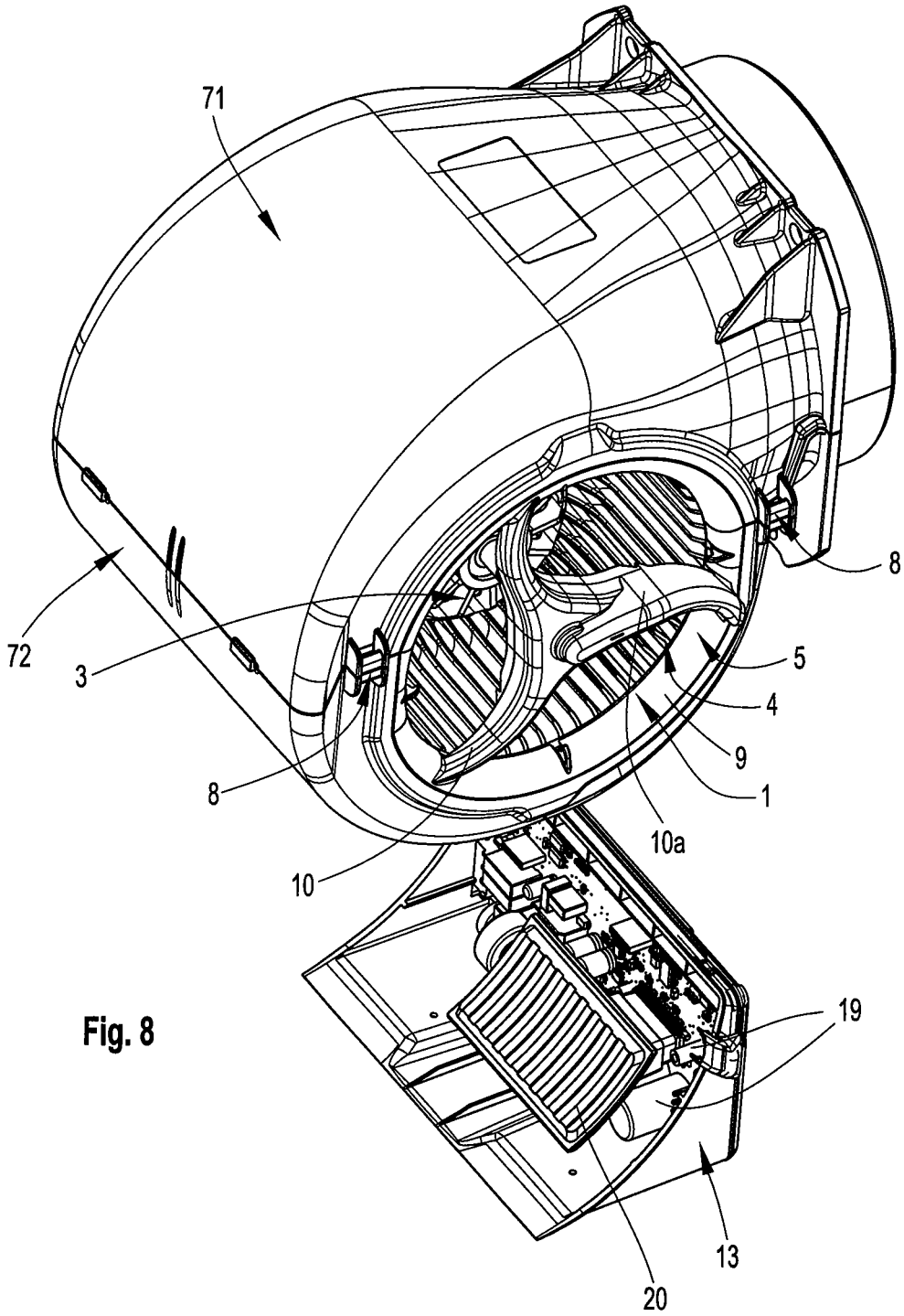
FIG. 8 shows a perspective illustration of the radial blower according to the invention in a view from above, with a terminal box removed.

The terminal box 13, which is illustrated in FIGS. 1, 7 and 8, belongs to the housing subassembly and can be fastened releasably to one of the shell parts 71 and 72, in particular to the lower shell part 72. A screw connection or else, as illustrated, a latching may be provided for fastening.

According to the invention, there is provision for the electric motor 3 of the fan subassembly to be an electronically commutated direct current motor. As a result of the low mass of such an EC motor, by means of which, on the other hand, an increased blower power can be achieved, as compared with a known blower, furthermore, a very good decoupling result can also be achieved by known means, this being important for the reduction of solid-borne sound and bearing noises.

For vibration decoupling, as shown in FIG. 2, elastic elements 14 are attached onto the two ends of the carrying shaft and serve for the vibration-insulating holding of the electric motor 3 and the holding parts 5. In this case, the elastic elements 14 fastened on the side of the electrical connecting lines 12 has these lines reaching through it. As in this case becomes clear from the sectional illustration in FIG. 2, the elastic elements 14 are preferably in each case formed in one piece, but in each case consist of three portions, not designed in any more detail, which lie axially one behind the other. These are a carrier connection portion connected fixedly in terms of rotation to the holding part 5, a motor connection portion connected fixedly in terms of rotation to the carrying part 6, and an elastically twistable intermediate portion arranged between the two connection portions. The respective elastic element 14 may be connected to the carrying part 6 and/or to the holding part 5 via plug connections which are positive in the direction of rotation of the electric motor 3 and which thereby prevent relative rotations.

The stator 30 of the motor 3 may in this case advantageously be encapsulated and thus be protected against environmental influences, while the rotor 40 may preferably be open on both sides, so that the heat occurring in the stator 30 can easily be discharged out of the motor 3.

In particular, in this regard, the illustration in FIG. 3 shows that the stator 30 is surrounded, completely, by a pour-around material 15 for the stator lamination bundle 16, the winding 17 and all further components which, is known are present, such as the electrical connecting lines 12. The material may preferably be a thermosetting plastic. All the current-carrying parts are thereby insulated and cannot be touched, thus, as mentioned above, ensuring a high IP protection class and predestining the blower according to the invention particularly for use in fume extractor hoods.

Figure 4:
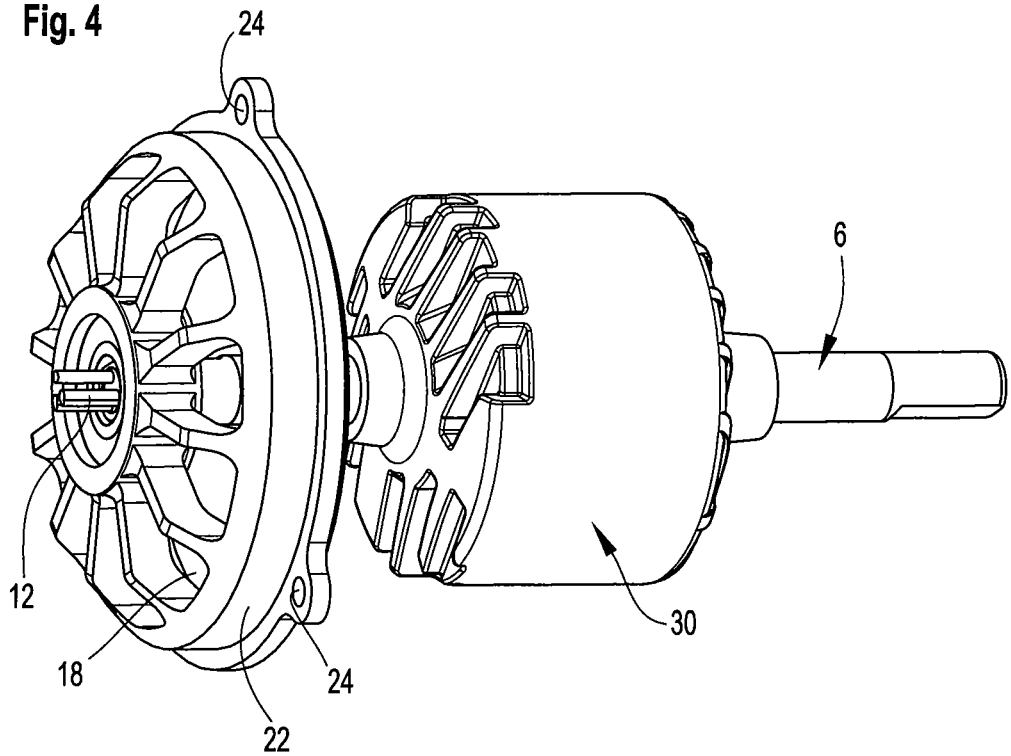
FIGS. 4 to 6 show in each case a perspective illustration of various assembly states of the radial blower according to the invention.
Figure 5:
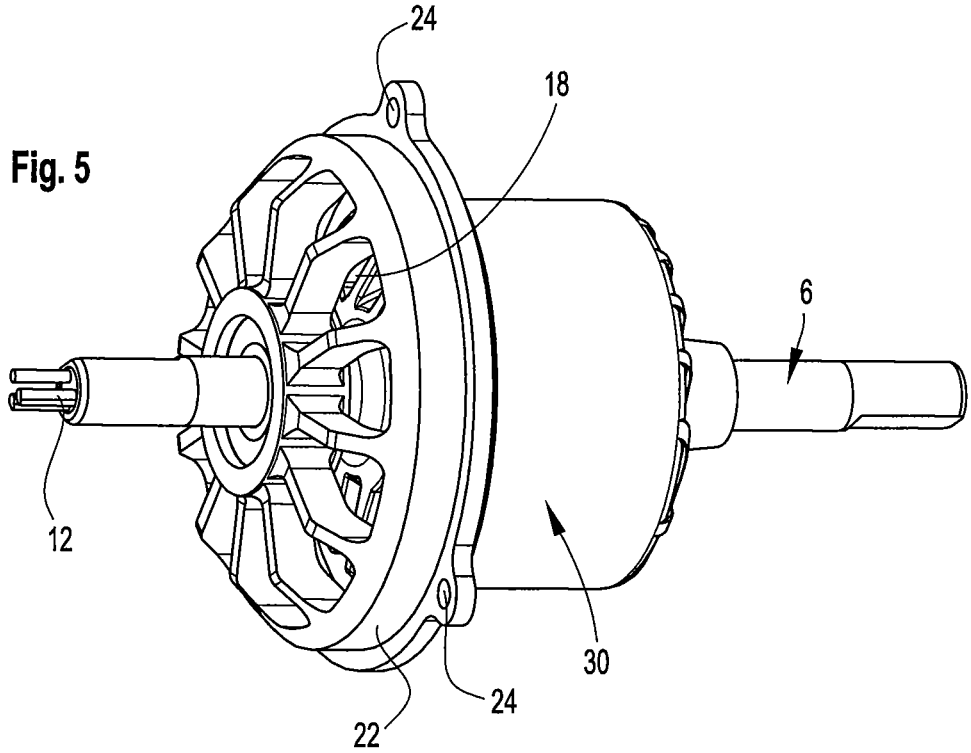

The encapsulation of the stator 30 makes it possible to provide the rotating rotor 40 with orifices 18 on both sides on its end faces, as illustrated in FIGS. 1, 4 and 5, without loss of quality in the degree of protection, even in relatively critical air conditioning applications. The orifices 18 in this case make it possible for the air, acting as cooling air, to flow around the stator 30 and thus ensure an optimal discharge of heat. Along with the encapsulation of the stator 30, in many instances a shorter motor subassembly may also be used, this advantageously entailing lower production costs.

As mentioned, the use according to the invention of an EC motor implies the need for the presence of special electronics for electronic commutation. Thus, the motor 3 can preferably be controlled without a sensor, the position of the rotor 40 being detected by means of a counter voltage induced in the stator windings 17 of the stator 30. Components representing these control electronics and bearing the reference symbol 19 are designated by way of example in FIGS. 7 and 8.

As already stated and shown in the version illustrated, the control electronics 19 may advantageously be arranged separately from the motor 3 in the housing subassembly. An air intake obstruction which occurs in known EC motors is consequently avoided.

In particular, the control electronics 19 may in this case be arranged in the terminal box 13 which thereby at the same time advantageously assumes the function of an electronic housing. A separate electronic housing may therefore be dispensed with.

The control electronics 19 may preferably form an electronic module which is mountable as a whole and which can be inserted, in particular plugged, into a clearance or onto a mounting location, provided for this purpose, of the terminal box 13. In this case, for cooling the electronics 19, a cooling body 20 may be provided which projects into a clearance 21 in the housing shell 72 out of the terminal box 13 into the space formed by the housing shells 71 and 72 and which thus is in direct contact with the airstream inside the blower. By the action of the blower air, an optimum flow around the cooling body 20 takes place.

In this case, with a view to minimizing the flow losses of the air, it is especially advantageous if the cooling body 20 has, as shown particularly in FIG. 7, a shape which is adapted to the housing wall, that is to say is, for example, curved arcuately. Further, with a view to protecting the electronics 19 in the terminal box 13 against the adverse action of environmental influences, it is advantageous if the cooling body closes the clearance 21 in the housing shell 72, in particular closes it sealingly, if appropriate in the presence of an initial seal, so that the air possibly laden with substances having a harmful effect upon the control electronics 19 does not enter the terminal box 13. Moreover, as can likewise been seen from FIG. 7, the cooling body 20 may have an angled, for example V-shaped basic configuration in terms of efficient cooling and of adaptation to the construction space in the terminal box 13, one leg of the angle representing the surface which is cooled by the blower air and which is usually provided with cooling ribs, while the other leg extends entirely inside the terminal box 13 and has sufficiently large dimensioning for the absorption of heat from the control electronics 19, in particular from their components KT to be cooled specially. Furthermore, in this case, there may also be provision for the cooling body 20 and the component KT to be cooled specially to be fastened or fastenable to one another, as shown.

The production or assembly of the blower according to the invention is simple, while, as a result of a modular set-up in which the individual basic elements can be mounted simply by being plugged together or snapped or screwed to one another, a short assembly time and also the possibility of optimal adaptation to different user interfaces can be achieved. For manufacturing the blower according to the invention, the production of the stator 30 or of a stator subassembly (including the carrying part 6) is first carried out, as is illustrated in FIG. 3. The stator subassembly comprises a stator lamination bundle 16 and the stator winding 17 with the connecting line 12 which is routed through the shaft, hollow on one side, to the junction points on the stator. The stator subassembly is encapsulated by means of the pour-around plastic 15.

Then, as shown in FIGS. 4 and 5, an end-face flange 22 of the rotor 40 is first pushed over the connecting cable 12 and then onto the shaft (carrying part 6). This unit and also the opposite flange 22 of the rotor 40 are then fastened to a prefabricated fan unit, shown in FIG. 6, by means of screws 23 which are led through the bores 24 and the rotor flange 22.

A prefabricated fan unit means in this context that it comprises both the fan wheel 4 with its fan blades 25 and the rotor 40 of the motor 3. The fan wheel 4 with the fan blades 25 and the rotor 40 form a one-piece component. The rotor 40 may in this case—see FIGS. 2 and 7—be formed from a magnetic return ring 26, to which magnetic segments 27 are fastened on the inside and which has a plastic casing 28 injection-molded around it on the outside approximately in tubular form. As shown in FIG. 2, the magnetic segments 27 may be preassembled in two rows lying axially next to one another and each having a plurality of magnetic segments 27 and a slight circumferential angle offset circumferentially with respect to one another. Single-row magnetic segments 27 or a magnetic strip are, of course, also possible, depending on the construction size of the motor.

In the illustrated version of the invention, the plastic casing 28 merges into the final blades 25 via a disk-shaped region 29 arranged at right angles to the motor axis, in particular centrally. As a result of this casing 28 of the metallic magnetic return ring 26 with the magnetic segments 27 on the one hand and by the fan wheel 4 being formed materially integrally with the plastic casing 28, the preassembled fan unit has an advantageously compact type of construction. The unit fulfils the electrotechnical function of the rotor 40 and at the same time is designed as a fan blade arrangement for fulfilling the airflow-related tasks. In this case, the use of metal material is restricted to the magnetic return ring 26, and therefore a weight reduction can also be achieved, as compared with conventional fan subassemblies. A surface treatment of the rotor body for the purpose of corrosion protection may advantageously be dispensed with because the plastic is completely injection-molded around 28. Also, when the magnetic return ring 26 is electrostatically charged, a charge outflow due to stray currents, for example via the rotor shaft (which is not present as such in the blower according to the invention) or via the shaft bearings 60, which are seated centrally in the end-face flanges 22 and therefore form bearing flanges of the motor 3, cannot occur, since the rotor 40 is insulated completely by the plastic.

Figure 6:
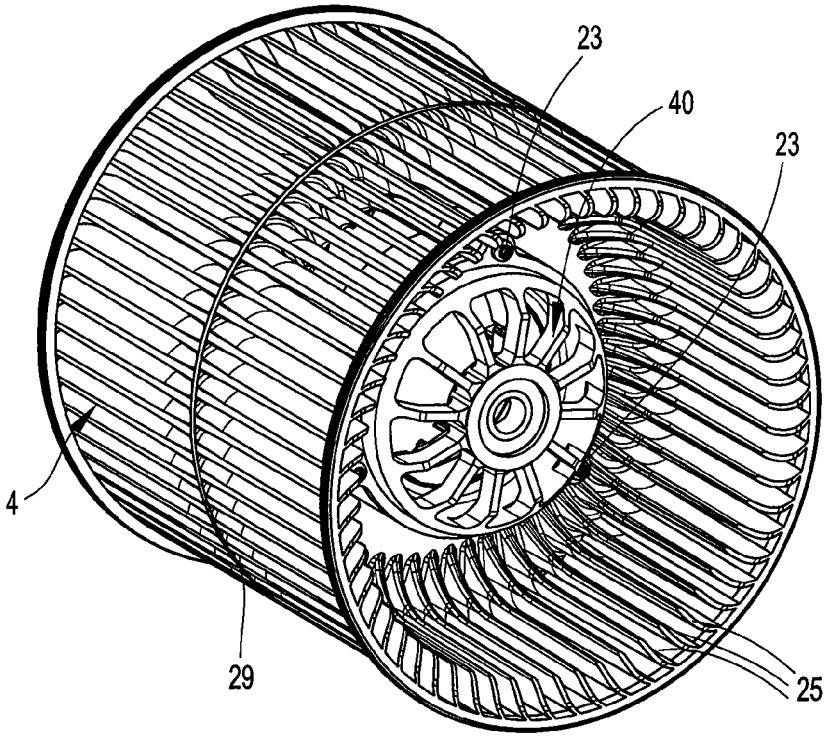

After the motor 3 is mounted in the inner space of the fan unit according to FIG. 6, this unit is provided on both sides of the carrying part 6 with vibration-insulating elastic elements 14, illustrated in FIG. 2, which are preferably inserted into additional bell-like carrier elements 70 present on the outside of the elastic elements 14. This unit is then connected centrically to the holding parts 5, in particular is plugged into the holding parts 5 and inserted between the shell parts 71 and 72 of the housing subassembly.

Finally, the mounting of the terminal box 13 or of the electronic housing on the lower shell part 72 takes place. In this case, the cooling body 20 is inserted into the clearance 21 of the shell part 72, so that, when the blower is running, the said cooling body can be swept by the airstream and consequently be cooled.

In summary, the following important advantages which distinguish a blower according to the invention can be stated:

- a comparatively low mass/power ratio, along with an optimal use of material, a small construction size and high motor efficiency,
- a reduction in the number of component variants due to a modular building block type of construction, in particular of the motor, housing and electronics, which is adaptable to different power stages,
- simple mounting and plug-ready functional modules adaptable to different customer interfaces,
- high IP protection,
- optimal heat management with a high permissible motor operating temperature.

The present invention is not restricted to the exemplary embodiment illustrated, but embraces all means and measures acting identically within the meaning of the invention, for example a single-flow blower. Thus, for example, the type of construction of the stator 30 or rotor 40 of the blower according to the invention may be different from that illustrated above, without departing from the scope of the invention, although independent inventive significance is likewise attributed to the electric motor 3 described and to its use.

Furthermore, the invention is not restricted to the feature combination defined herein, but may also be defined by any other desired combination of the specific features of all the individual features disclosed as a whole. This means that basically virtually any individual feature of the description may be omitted or be replaced by at least one individual feature disclosed elsewhere in the application.

The invention claimed is:

1. A radial blower having at least one axial air inlet port and with a radial air outlet port, comprising a housing subassembly and a fan subassembly, the fan subassembly having an electric motor with a stator and a rotor, and a fan wheel, the housing subassembly having at least one holding part, which is arranged in the region of the at least one axial air inlet port and serves for the supporting reception of a carrying part of the fan subassembly, and a housing shell having two shell parts which are connectable releasably to one another and divide the air inlet port and between which the holding part is fastened in the assembled state of the radial blower, the electric motor of the fan subassembly is an electronically commutated direct current motor, the housing subassembly further comprising a terminal box and control electronics arranged in the terminal box for reception of a motor connection line, the terminal box being fastened to an underside of one of the shell parts of the housing subassembly, and the control electronics forming an electronic module having an integrated circuit and having a cooling body projecting into a clearance in the housing shell, to which the terminal box is fastened, the cooling body having a back plate with fins extending therefrom, the cooling body being in direct contact with an airstream inside the blower, sealingly closing the clearance in the housing shell and sealingly separating the control electronics from the airstream, wherein the back plate has a curved shape that is parallel to a curvature of an inner surface of the housing shell facing the fan wheel near the clearance, wherein the stator is encapsulated on all sides by a pour-around material and the rotor has two open end faces.

2. The radial blower according to claim 1, further comprising that the electric motor is sensor-controlled, that the position of a rotor of the electric motor being detected by at least one magnetic, electric or optical position sensor.

3. The radial blower according to claim 1, further comprising that the electric motor is controlled by utilizing a detection of the position of a rotor of the electric motor via a counter-voltage induced in windings of a stator of the electric motor.

4. The radial blower according to claim 1, further comprising that the cooling body has a shape which is adapted to the housing shell which is curved arcuately.

5. The radial blower according to claim 1 further comprising that the cooling body has an angled configuration with two legs, one leg of the angle being in contact with the airstream inside the blower, while the other leg extends inside the terminal box.

6. The radial blower according to claim 1 further comprising that two of the at least one air inlet ports are arranged axially opposite one another in the housing subassembly.

7. The radial blower according to claim 1 further comprising that the carrying part is designed as an elongate carrying shaft which is held with ends thereof in the holding parts and on which a stator of the electric motor is non-rotatably seated and on which a rotor of the electric motor is mounted rotatably as an external rotor.

8. The radial blower according to claim 7 further comprising that the carrying part is designed at least partially, coming from one shaft end, as a hollow shaft, the carrying part having an inner guide duct for the reception of a connecting line for the electric motor.

9. The radial blower according to claim 1 further comprising that the carrying part is connected to the holding part via an elastic element, the elastic element consisting of three portions lying axially one behind the other, including a carrier connection portion non-rotatably connected to the carrier part, a motor connection portion non-rotatably connected to the carrier part, and an elastically deformable intermediate portion arranged between the two connection portions.

10. The blower according to claim 1 further comprising that a rotor of the electric motor has orifices in flanges.

11. The radial blower according to claim 1 further comprising that a rotor of the electric motor forms with the fan wheel a prefabricated fan unit.

12. The radial blower according to claim 11, further comprising that the rotor is formed from a magnetic return ring, to which one or more magnetic segments are fastened on the inside thereof and which is surrounded by a plastic casing on the outside in a tubular form.

13. The radial blower according to claim 12, further comprising that the plastic casing merges into blades of the fan wheel via a disk-shaped region arranged coaxially with the electric motor, the plastic casing being formed materially integrally with the fan wheel.

14. The radial blower according to claim 1, wherein the airstream is guided from the fan wheel to the outlet port.

* * * * *